US008623795B2

(12) United States Patent
Douglass et al.

(10) Patent No.: US 8,623,795 B2
(45) Date of Patent: Jan. 7, 2014

(54) METHOD FOR MAINTAINING ANTIWEAR PERFORMANCE OF TURBINE OILS CONTAINING POLYMERIZED AMINE ANTIOXIDANTS AND FOR IMPROVING THE DEPOSIT FORMATION RESISTANCE PERFORMANCE OF TURBINE OILS CONTAINING MONOMERIC AND/OR POLYMERIC ANTIOXIDANTS

(75) Inventors: Michael R. Douglass, Cherry Hill, NJ (US); Douglas Eugene Johnson, Cherry Hill, NJ (US); Susan Ardito, Ocean, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 140 days.

(21) Appl. No.: 13/190,977

(22) Filed: Jul. 26, 2011

(65) Prior Publication Data

US 2012/0142567 A1 Jun. 7, 2012

Related U.S. Application Data

(60) Provisional application No. 61/368,127, filed on Jul. 27, 2010.

(51) Int. Cl.
*C10M 137/04* (2006.01)

(52) U.S. Cl.
USPC ..... 508/423

(58) Field of Classification Search
USPC ..... 508/423
See application file for complete search history.

(56) References Cited

U.S. PATENT DOCUMENTS

| | | | | |
|---|---|---|---|---|
| 3,038,859 | A | 6/1962 | Eickemeyer et al. | |
| 3,121,109 | A | 2/1964 | Young | |
| 3,573,206 | A | 3/1971 | Braid et al. | |
| 4,780,229 | A | 10/1988 | Mullen | |
| 5,206,404 | A | 4/1993 | Gunkel et al. | |
| 5,344,468 | A | 9/1994 | Hanlon et al. | |
| 5,560,849 | A * | 10/1996 | Shankwalkar et al. | 508/423 |
| 2006/0073992 | A1 | 4/2006 | Dong et al. | |
| 2006/0127572 | A1 | 6/2006 | Raynaud | |
| 2006/0199748 | A1 | 9/2006 | Costello et al. | |
| 2007/0179069 | A1 | 8/2007 | Burgo et al. | |
| 2007/0232504 | A1 * | 10/2007 | Goyal et al. | 508/192 |
| 2008/0058235 | A1 | 3/2008 | Takigawa et al. | |
| 2009/0253597 | A1 | 10/2009 | Wardlow et al. | |

FOREIGN PATENT DOCUMENTS

| | | | |
|---|---|---|---|
| EP | 521628 | A2 * | 1/1993 |
| EP | 0612837 | | 12/1993 |
| EP | 0612837 | | 8/1994 |
| EP | 0521628 | | 3/1996 |

OTHER PUBLICATIONS

Copending, Commonly Owned U.S. Appl. No. 61/368,136, filed Jul. 27, 2010.

(Continued)

*Primary Examiner* — Taiwo Oladapo
(74) *Attorney, Agent, or Firm* — Robert A. Migliorini

(57) ABSTRACT

The antiwear performance of turbine oils containing polymerized amine antioxidants and antiwear additives is maintained at or enhanced beyond the level as that of turbine oils containing monomeric amine antioxidants by employing as the antiwear additive a resorcinol bis(diphenylphosphate) (RDP). The deposit formation resistance performance of turbine oils containing monomeric and/or polymeric amine antioxidant is improved by employing RDP.

8 Claims, 7 Drawing Sheets

(56) References Cited

OTHER PUBLICATIONS

Figure 1:
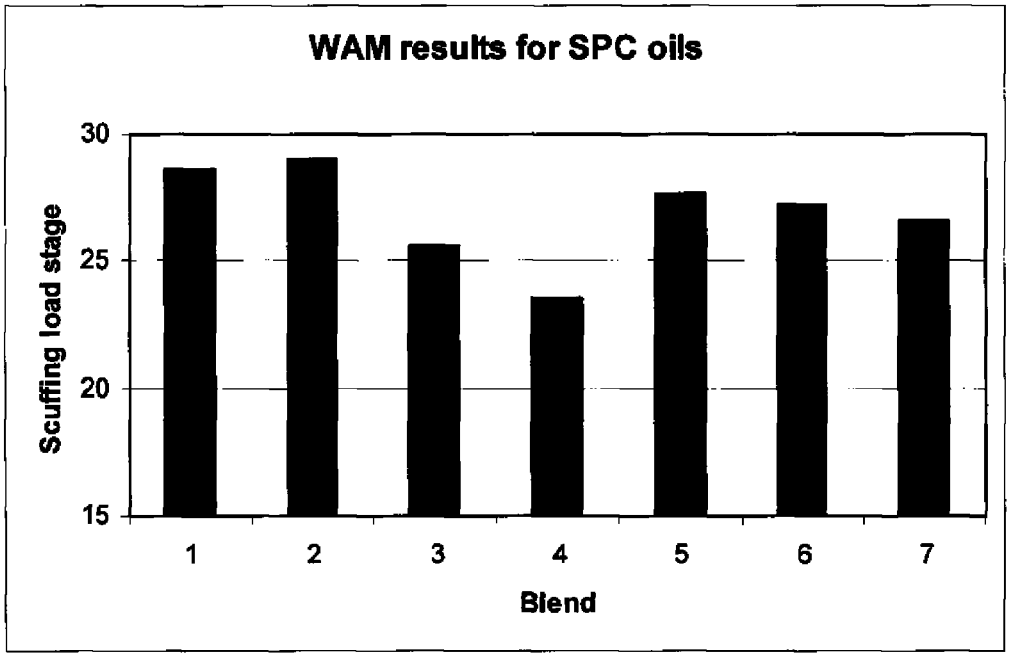
Figure 2:
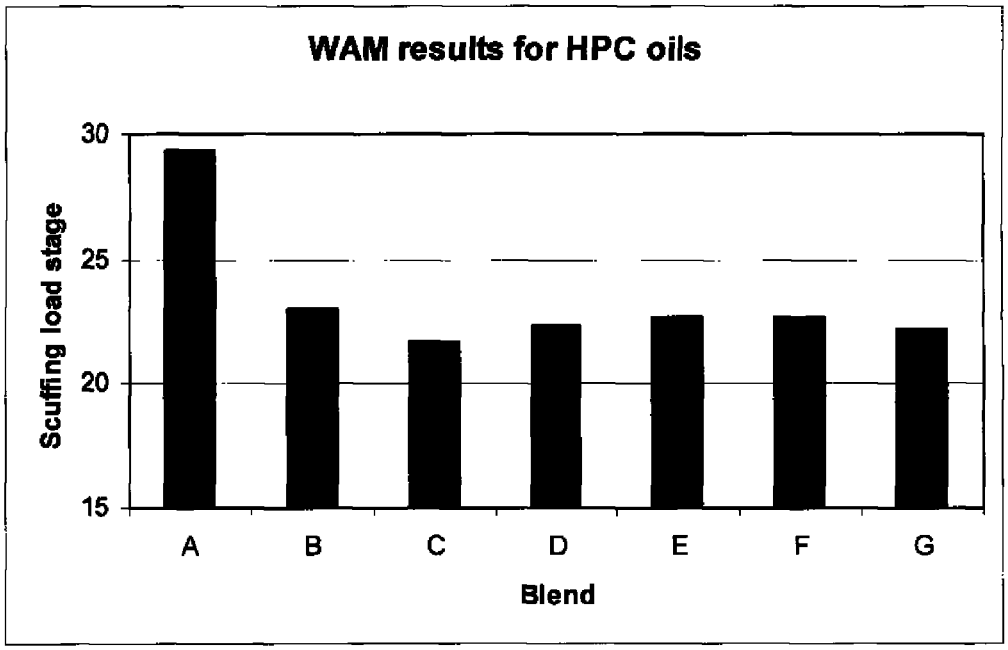
Figure 3:
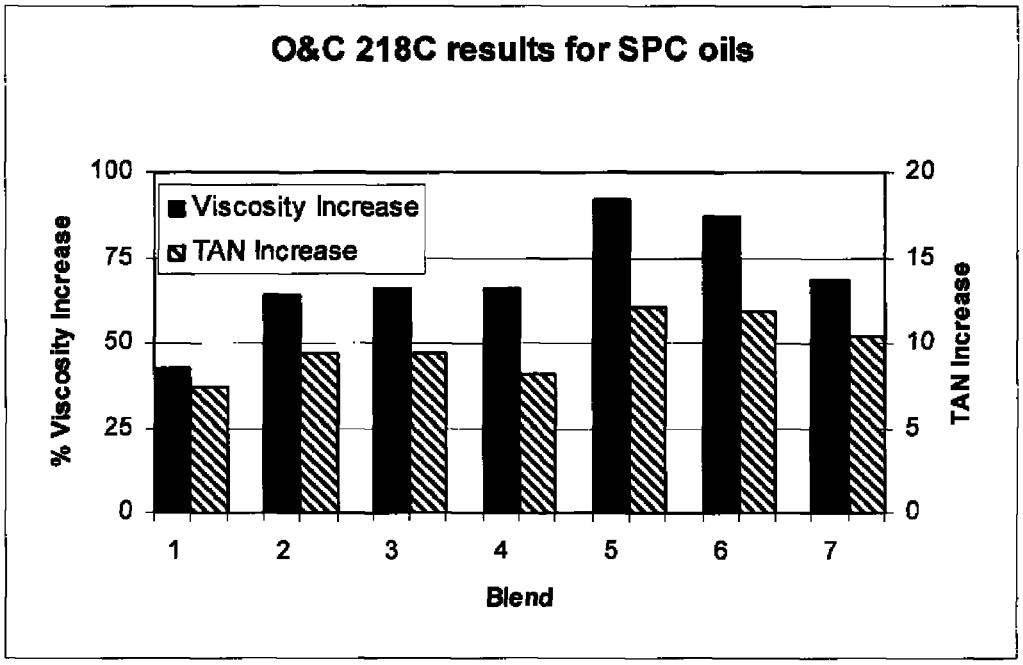
Figure 4:
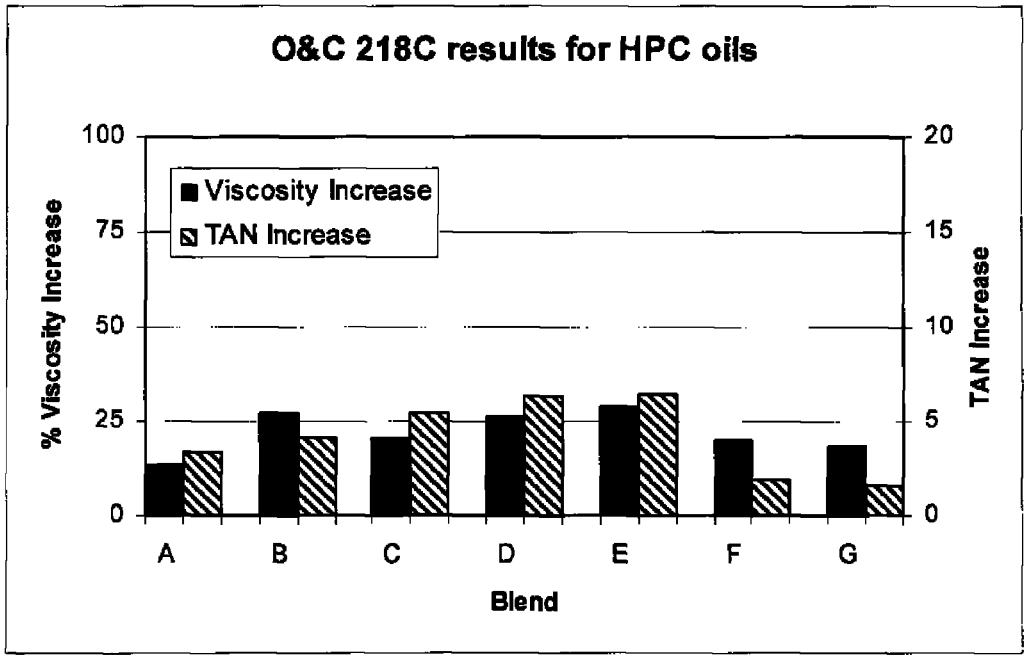
Figure 5:
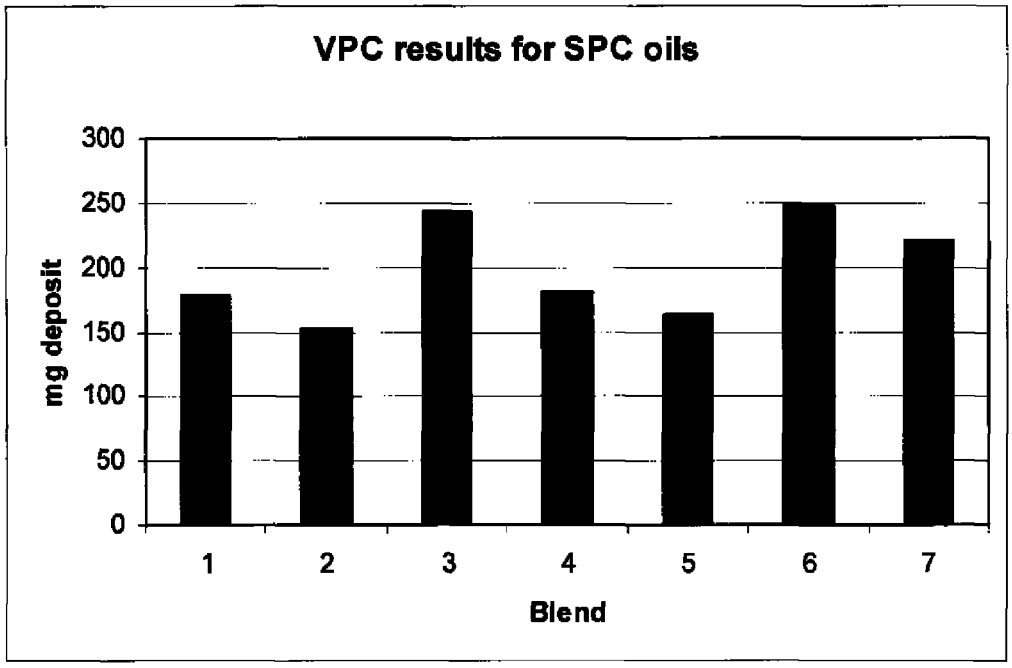
Figure 6:
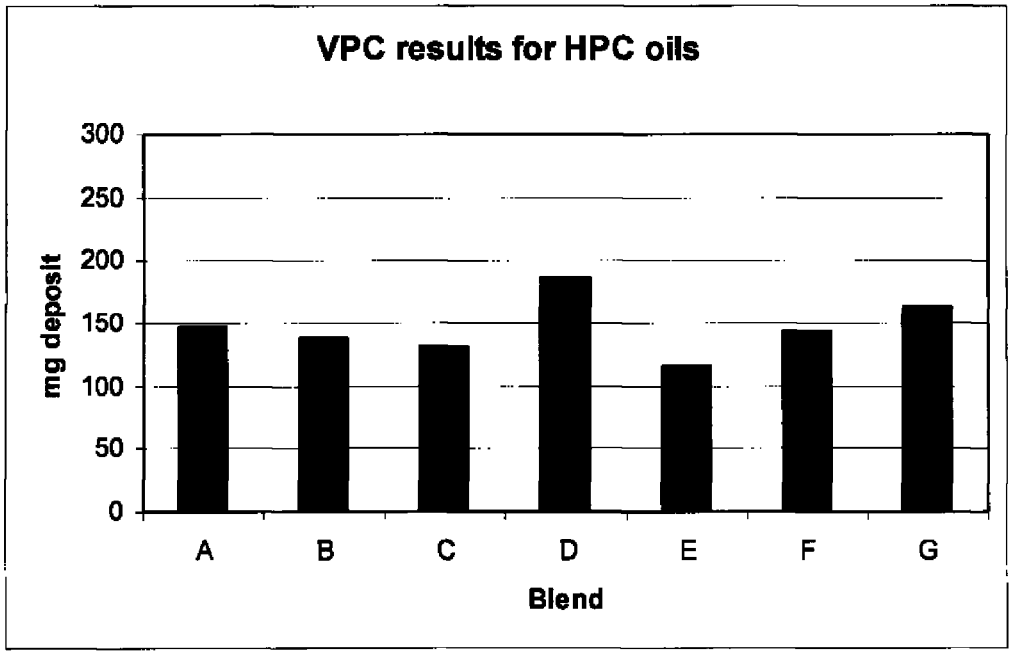
Figure 7:
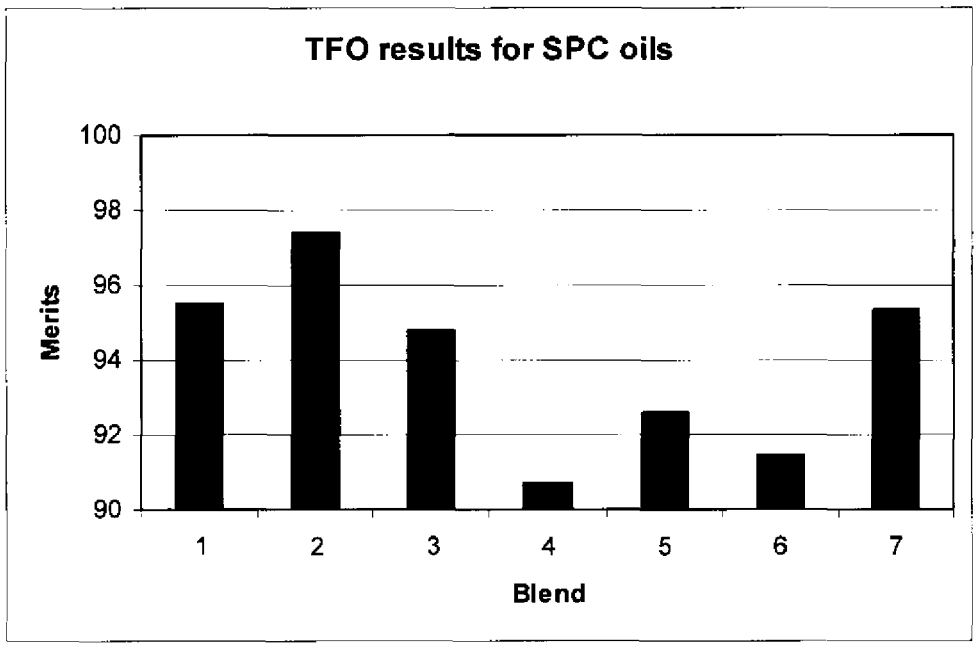
Figure 8:
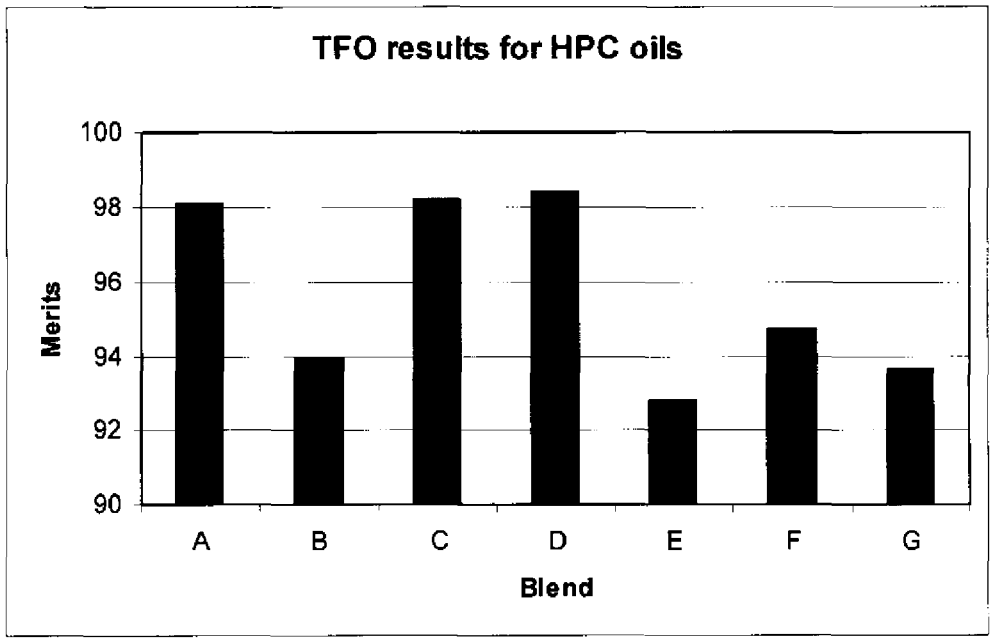
Figure 9:
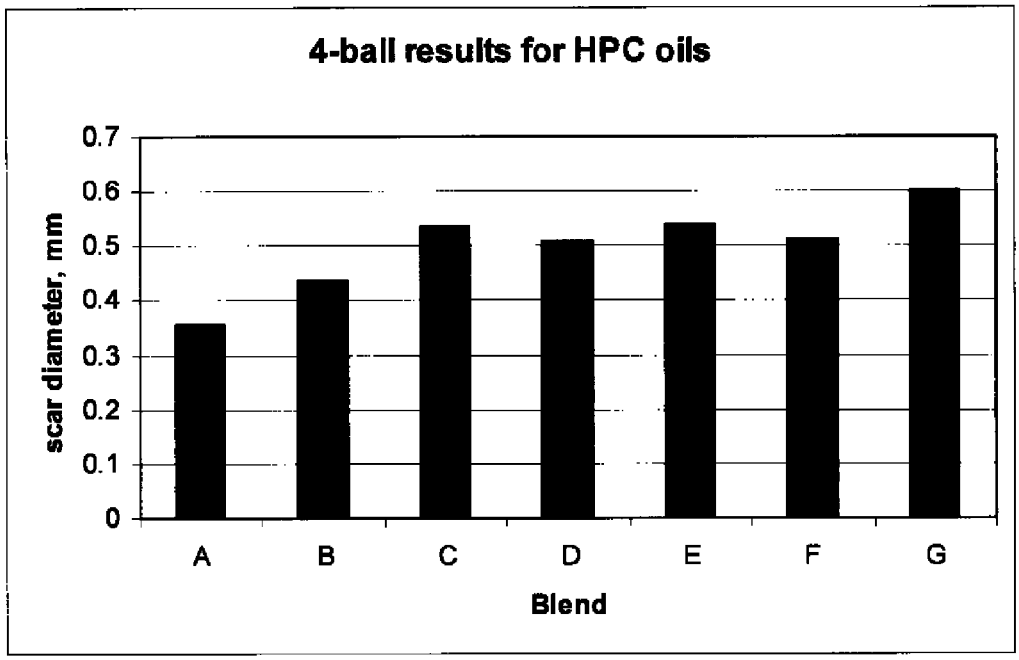
Figure 10:
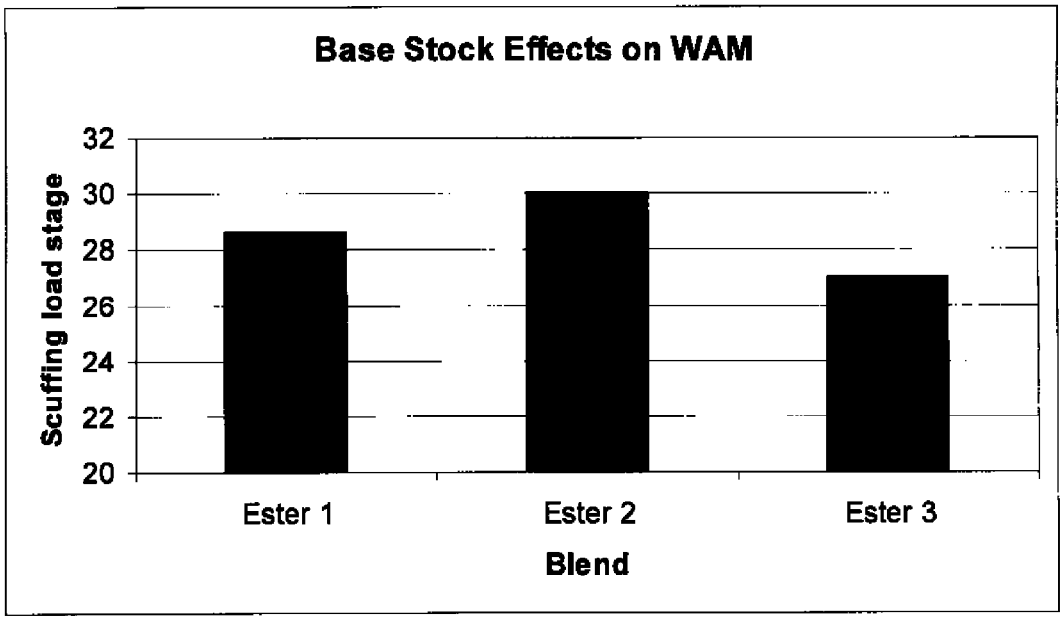
Figure 11:
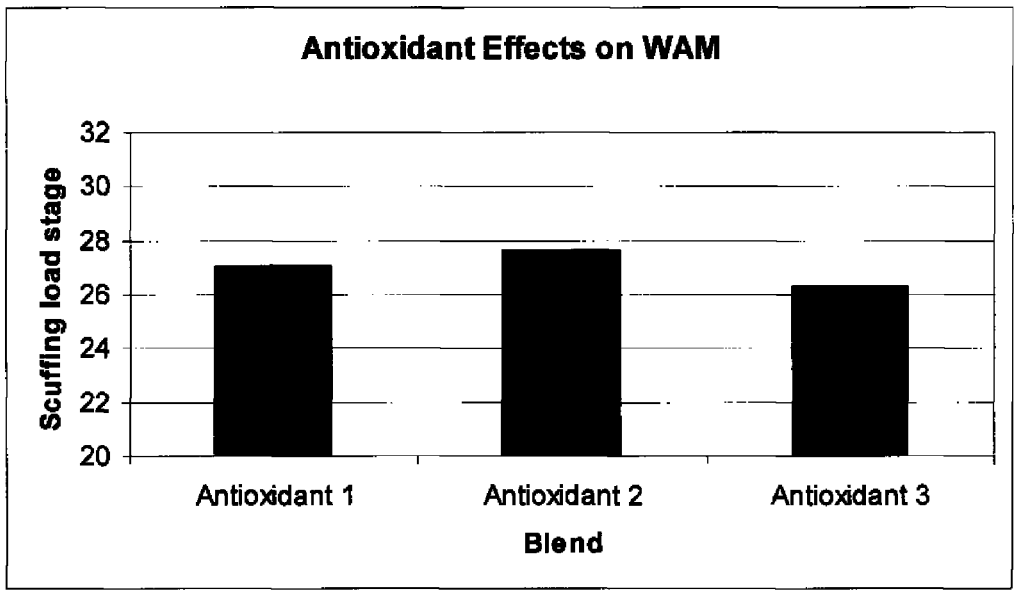
Figure 12:
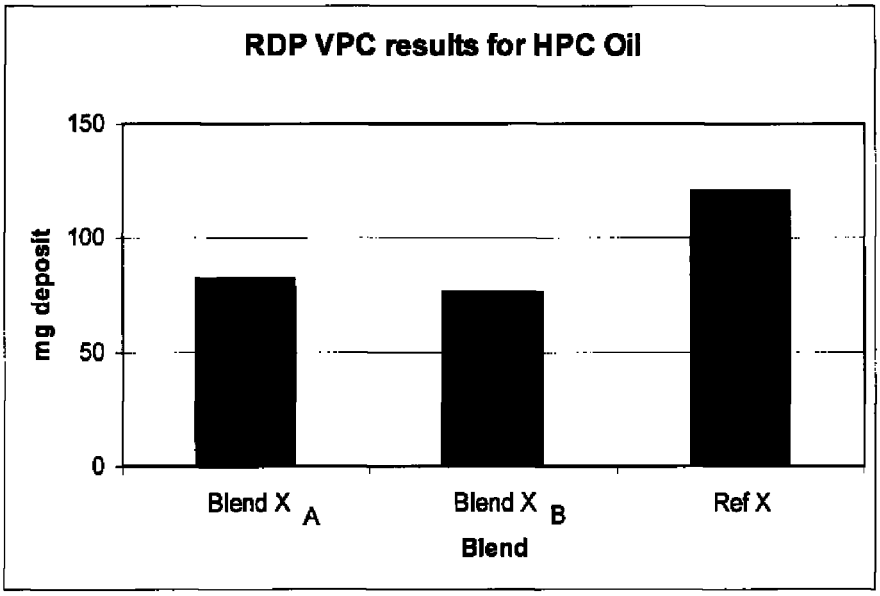
Figure 13:
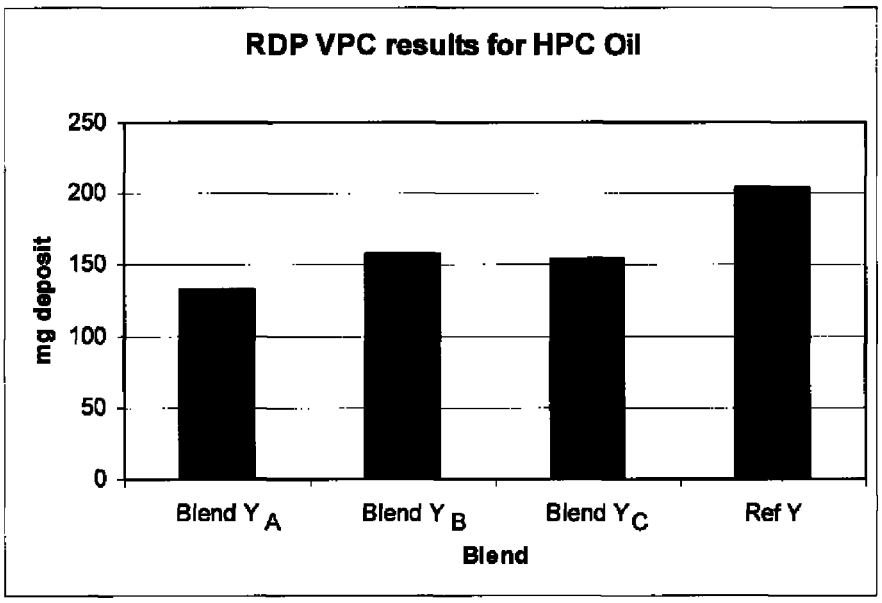
Figure 14:
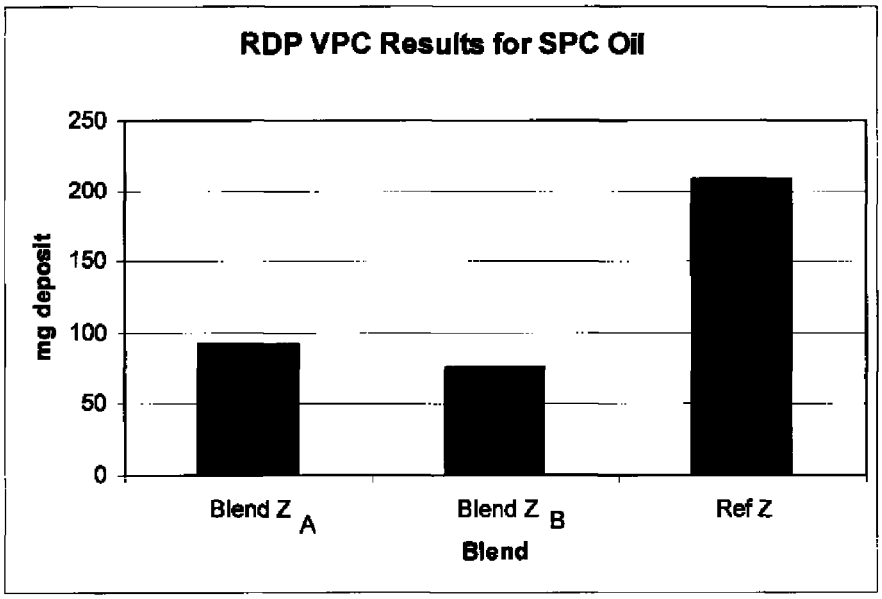

A. Nagarajan, C. Garrido, J. E. Gatica and W. Morales, "Phosphate Reactions as Mechanisms of High-Temperature Lubrication", NASA/TM-2006-214060, May 2006.
A. Nagarajan, C. Garrido, W. Morales and J. E. Gatica, "Chemical Vapor Deposition Applications in Thin-Film Coatings for High Temperature Lubrication", AIChE Annual Meeting, Conference Proceedings, Cincinnati, Ohio, Oct. 30-Nov. 4, 2005 (564a/I-564a/11).
D. W. Johnson and S. Morrow, "Vapor-Phase Lubrication: Reaction of Phosphate Ester Vapors with Iron and Steel", Chem. Mater., 2002, 14, 3767-3775.
R. Henrich, B.M. Ryan, R. Selby, S. Garthwaite, R. Morrissey and R.I. Greudenthal, "Two-Generation Oral (Diet) Reproductive Toxicity Study of Resorcinol Bis-Diphenylphosphate (Fyrolflex RDP) in Rats", International Journal of Toxicology, 2000, 19, 243-255.
B.M. Ryan, R. Henrich, E. Mallett and R.I. Freudenthal, "Development Toxicity Study of Orally Administered Resorcinol Bis-Diphenylphosphate (RDP) in Rabbits", International Journal of Toxicology, 2000, 19, 257-264.
R.L. Sherwood, R.V. House, H.V. Ratajczak, R.I. Freudenthal and R.T. Henrich, "Immunotoxicity Evaluation of Resorcinol Bis-Diphenylphosphate (Fyrolflex FDP) in B6C3F1 Mice", International Journal of Toxicology, 2000, 19, 265-275.
R.T. Henrich, W.D. Johnson, N. Rajendran, R.I. Freudenthal, M.J. Tomlinson and C. Aranyi, "Twenty-Eight Day Nose-Only Inhalation Toxicity Study of Resorcinol Bis-Diphenylphosphate (Fyrolflex RDP) in Rats", International Journal of Toxicology, 2000, 19, 223-231.
R.I. Freudenthal, L.J. McDonald, J.V. Johnson, D.L. McCormick and R.T. Henrich, "Comparative Metabolism and Toxicokinetics of 14C-Resorcinol Bis-Diphenylphosphate (RDP) in the Rat, Mouse and Monkey", International Journal of Toxicology, 2000, 19, 233-243.
Aerospace Information Letter No. 4978 Revision B, "Temporary Methods for Assessing the Load Carrying Capacity of Aircraft Propulsion System Lubricating Oils", The Engineering Society for Advanced Mobility Land Sea Air and Space, 2002.
Aerospace Information Letter No. 5921 (1st Draft—for Peer Review), "Evaluation of Coking Propensity of Aviation Lubricants in an Air-Oil Mist Environment Using the Vapor Phase Coker", The Engineering Society for Advanced Mobility Land Sea Air and Space, 2011.
E.A. Oberright, S.J. Leonard and H.L. Hepplewhite, "Deposit-Forming Tendencies of High-Temperature Lubricants", ASLE Translations, 1964, 7, 64-72.
J.M. Hall, "Anti-Wear Additives in Neopentyl Ester Oils", 26th ASLE Annual Meeting in Boston, Massachusetts, May 3-6, 1971.
S.G. Shankwalkar and D.G. Placek, "Oxidation and Weight Loss Characteristics of Commercial Phosphate Esters", Ind. Eng. Chem. Res., 1992, 31, 1810-1813.
D.H. Han and M. Masuko, "Elucidation of the Antiwear Performance of Several Organic Phosphates Used with Different Polyol Ester Base Oils from the Aspect of Interaction between Additive and Base Oil", 53rd Annual Meeting in Detroit, Michigan, May 17-21, 1998, Tribology Transactions, 1998, 41, 4, 600-604.
C. Duncan, J. Reyes-Galivan, D. Costantini and S. Oshode, "Ashless Additives and New Polyol Ester Base Oils Formulated for Use in Biodegradable Hydraulic Fluid Applications", Lubrication Engineering, 2002, 58, 9, 18-28.
H.K. Trivedi,N.H. Forster and C.S. Saba, "Rolling contact fatigue testing of a 3 cSt polyolester lubricant with and without TCP and DODPA/PANA at 177 degrees C", Tribology Letters, Apr. 2004, 16, 3, 231-237.

* cited by examiner

METHOD FOR MAINTAINING ANTIWEAR PERFORMANCE OF TURBINE OILS CONTAINING POLYMERIZED AMINE ANTIOXIDANTS AND FOR IMPROVING THE DEPOSIT FORMATION RESISTANCE PERFORMANCE OF TURBINE OILS CONTAINING MONOMERIC AND/OR POLYMERIC ANTIOXIDANTS

CROSS-REFERENCE TO RELATED APPLICATIONS

This is a non-provisional application that claims priority to U.S. Provisional Patent Application No. 61/368,127 filed on Jul. 27, 2010, herein incorporated by reference in its entirety.

FIELD

The present disclosure relates to turbine oils containing antiwear additives and antioxidants and to the maintenance and/or improvement of the antiwear performance and the deposit formation resistance performance of such turbine oils.

BACKGROUND

Turbine oils, especially aviation jet engine oils, are complex liquid lubricants designed to function under extreme conditions of temperature, pressure and load. At such conditions the turbine oil experiences volatilization of vital components as well as a loss of the ability to control or inhibit wear of critical engine parts.

To control wear, the liquid lubricant typically employs additives specifically designed as antiwear additives. Typical turbine antiwear additives are addressed and described in the prior art.

EP 0,521,628 is directed to a combination of aryl phosphates useful as antiwear additives in fuels, lubricants and functional fluids which are subjected to high temperatures under actual service conditions. The combination of aryl phosphates is comprised of: (1) at least one oil-soluble aryl phosphate of the formula:

$$(RO)_3PO$$

wherein each R is, independently, phenyl or an alkyl-substituted phenyl group; and (2) at least one oil-soluble aryl phosphate of the formula:

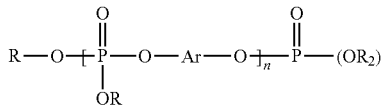

wherein each R is, independently, phenyl or an alkyl-substituted phenyl group, Ar is m-phenylene or an alkyl-substituted m-phenylene group, and n is a number from 1 to 4, said combination containing from 2 to 30% by weight of component (1). When the above formula represents a mixture of the depicted polyphosphates, n is a whole or fractional number from 1 to 4, because n in that case represents the average composition of the mixture.

The lubricant compositions which can be benefited by the use of the composition combination are lubricating oils of lubricating viscosity, including oils composed by volume of at least 50% up to and including 100% of one or more mineral oils or one or more synthetic ester oils.

In forming the combination of aryl phosphates, use can be made of phenol and/or one or more alkyl phenols containing from 1 to 5 alkyl groups on the ring. Each alkyl group can contain up to about 18 carbon atoms provided the alkyl substituents do not sterically hinder the hydroxyl group to such an extent that the substituted phenol cannot undergo reaction to form the desired aryl phosphate.

The combination of aryl phosphates is reported to have excellent thermal stability at high temperatures, even as high as 400° C., compared to tri-n-octyl phosphate (TOP), tricresyl phosphate (TCP), tri-n-butoxy-ethyl phosphate (TBEP), and cresyl diphenyl phosphate (CDP).

When used as lubricating oil antiwear additive, the combination is employed in the range 0.005 to 20 wt % based on the total weight of the finished lubricant. The finished lubricant can contain additional additives, including ashless dispersants, zinc hydrocarbyl dithiophosphates, one or more oil-soluble sulfur-containing antiwear and/or extreme pressure agents.

U.S. Pat. No. 5,560,849 is directed to improving the antiwear properties of synthetic ester lubricants intended for use at high temperatures (150 to 350° C.) by adding to the lubricant a hydrocarbon-insoluble, synthetic ester-soluble, aryl diphosphate ester composition containing a major amount of an aryl diphosphate ester of the formula:

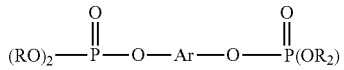

wherein Ar is an unsubstituted or alkyl ($C_1$ to $C_{12}$)-substituted arylene and R is unsubstituted or alkyl ($C_1$ to $C_{12}$)-substituted aryl.

The alkyl diphosphate ester exhibits high thermal stability, making it suitable for use as an antiwear additive in lubricants used at high temperature as a replacement for a tri-aryl phosphate ester (e.g., TCP).

The aryl diphosphate ester is employed in synthetic ester base stocks including polyol esters, diesters and phosphate esters in amounts in the range 0.1 to 10%, preferably 0.5 to 5%, based on the weight of the synthetic ester. Other additives may also be present in the synthetic ester lubricant and include lubricating agents, other antiwear additives, antioxidants, metal passivators, rust and/or corrosion inhibitors, viscosity index (VI) improvers, detergents/dispersants, defoamers/antifoamants, emulsion modifiers, seal swell agents, tackifiers, stabilizers, dyes and odor-masking agents. Antioxidants include hindered phenols, aromatic amines and zinc dialkyl/diaryl phosphate (ZDDP).

EP 0,612,837 is directed to a polyphenylene ether lubricant containing hydrocarbyl bis(dihydrocarbyl phosphate) compounds of the formula:

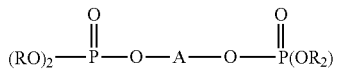

wherein R is either unsubstituted or substituted hydrocarbyl alkyl or aryl group, A is a bridging group alkylene, haloalkylene, arylene, two arylene groups joined by a bridging group (e.g., —$C(CH_3)$, —$SO_2$ or —CO) or a bridging group containing biarylene, the di-phosphate compound being used as an antiwear additive in an amount in the range of about 0.1 to 10% by weight of the lubricating composition.

U.S. Published Application 2007/0179069 is directed to high temperature, stable lubricant compositions comprising at least one polyol polyester derived from the reaction product of a neopentyl polyol with 5,7,7-trimethyl-2-(1,3,3-trimethylbutyl)-octanoic acid. This polyolester can be used in combination with other conventional polyolesters as well as in combination with other additives, including metal protecting additives such as t-butyl phenyl phosphate, mono-hexyl and di-hexyl phosphates, isopropylphenyl phosphates, tri-cresyl phosphates, tri-xylyl phosphates, di(n-octyl) phosphate, alkylated tri-phenyl phosphorothionate, tri-phenyl thiophosphate, benzotriazole, tolyltriazole and mixtures, derivatives and combinations thereof in amounts in the range of about 0.1 to 10%, preferably up to about 5%, by weight of the total composition.

Other lubricant additives include alkylated di-phenyl amines, nonylated di-phenylamine, styrenated di-phenyl amine and hindered alkyl phenols.

U.S. Pat. No. 5,206,404 is directed to a composition of alkylated phenyl phosphate esters comprising 1 to 20 wt % tri-alkyl phenyl phosphate, 10 to 50 wt % di-alkyl phenyl mono-phenyl phosphate, 15 to 60 wt % mono-alkyl phenyl di-phenyl phosphate and less than 2 wt % tri-phenyl phosphate exhibiting a combination of excellent thermal, oxidative and hydrolytic stability. Unexpectedly superior thermal and hydrolytic stability properties are obtained when the alkyl moiety is a tertiary alkyl, preferably a t-butyl moiety.

The phosphate esters are an ashless antiwear base stock of reduced volatility and find further use as a lubricant additive.

"Phosphate Reactions as Mechanisms of High Temperature Lubrication", Nagarajan, A. et al., NASA/TM-2006-213060, is directed to the study of the chemical vapor deposition of tert-butyl phenyl phosphate (TBPP) on cast iron. TBPP is reported as possessing superior oxidative, thermal and hydrolytic stability compared to other commercial phosphate ester products and can be an effective and highly stable antiwear additive in both petroleum and synthetic base stocks including polyesters, diesters and polyalphaolefins.

See also "Chemical Vapor Deposition Applications in Thin Film Coatings for High Temperature Lubrication", Nagarajan, A. et al., AIChE Annual Meeting, Conference Proceedings, Cincinnati, Ohio, Oct. 30-Nov. 4, 2005 (564a/1-564a/11); and "Vapor-Phase Lubrication: Reaction of Phosphate Ester Vapors with Iron and Steel", Johnson, D. W. et al., Chem Mater, 2002, 14, 3767-3775.

While tri-alkyl phenyl phosphates are useful as antiwear additives in polyester base turbine oil formulations containing monomeric amine antioxidants, their performance has been found to be no more beneficial than tri-cresyl phosphate when employed in turbine oil formulation containing polymeric amine antioxidants. In fact, their performance as antiwear additives is negatively impacted when employed in high performance turbine oil formulations containing polymeric amine antioxidants.

It would be an advance in turbine oil technology if a way could be found to retain high antiwear performance in turbine oil formulations containing polymeric amine antioxidants. It would also be an advance in turbine oil technology if a way could be found to improve the deposition formation resistance performance of turbine oils containing monomeric or polymeric amine antioxidants.

SUMMARY

In one form of the present disclosure disclosed herein, there is provided a turbine oil exhibiting maintained or improved antiwear performance as specified in SAE specification AS 5780 comprising a synthetic ester base oil, one or more of a polymeric aminic antioxidant and RDP antiwear additive of the formula:

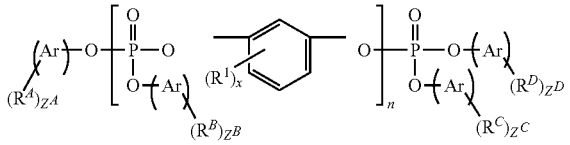

wherein $R^1$ is a $C_1$ to $C_5$ alkyl group, x is an integer ranging from zero to 4, n is an integer ranging from 1 to 7, each Ar is independently phenyl or naphthyl, $R^A$, $R^B$, $R^C$ and $R^D$ are the same or different $C_1$ to $C_{18}$ alkyl groups or hydrogen and where any of $R^A$ to $R^D$ are other than hydrogen the corresponding $Z^A$, $Z^B$, $Z^C$ and $Z^D$ are the same or different and range from 1 to up to the available valence of each Ar group, the RDP being present in an amount in the range 0.01 to 10 wt % based on active ingredient and contributing from 500 to 6000 ppm phosphorus, wherein the antiwear performance of the turbine oil as measured by the Wedeven Associates Machine (WAM) test ranges from greater than 23 to 30.

In another form of the present disclosure disclosed herein, there is provided a method for maintaining or enhancing the antiwear performance of a High Performance Category turbine oil comprising a synthetic ester base oil, one or more of a polymeric aminic antioxidant and RDP antiwear additive of the formula:

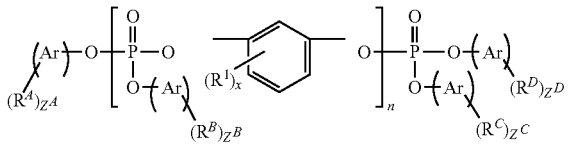

wherein $R^1$ is a $C_1$ to $C_5$ alkyl group, x is an integer ranging from zero to 4, n is an integer ranging from 1 to 7, each Ar is independently phenyl or naphthyl, $R^A$, $R^B$, $R^C$ and $R^D$ are the same or different $C_1$ to $C_{18}$ alkyl groups or hydrogen and where any of $R^A$ to $R^D$ are other than hydrogen the corresponding $Z^A$, $Z^B$, $Z^C$ and $Z^D$ are the same or different and range from 1 to up to the available valence of each Ar group, the RDP being present in an amount in the range 0.01 to 10 wt % based on active ingredient and contributing from 500 to 6000 ppm phosphorus, wherein the antiwear performance of the turbine oil as measured by the Wedeven Associates Machine (WAM) test ranges from greater than 23 to 30.

In yet another form of the present disclosure disclosed herein, there is provided a method for improving the resistance to deposit formation of turbine oil comprising a synthetic ester base oil, one or more polymeric or monomeric aromatic aminic antioxidants, and RDP antiwear additive of the formula:

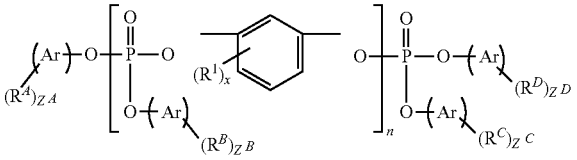

wherein $R^1$ is a $C_1$ to $C_5$ alkyl group, x is an integer ranging from zero to 4, n is an integer ranging from 1 to 7, each Ar is independently phenyl or naphthyl, $R^A$, $R^B$, $R^C$ and $R^D$ are the same or different $C_1$ to $C_{18}$ alkyl groups or hydrogen and where any of $R^A$ to $R^D$ are other than hydrogen the corresponding $Z^A$, $Z^B$, $Z^C$ and $Z^D$ are the same or different and range from 1 to up to the available valence of each Ar group, the RDP being present in an amount in the range 0.01 to 10 wt % based on active ingredient and contributing from 500 to 6000 ppm phosphorus, wherein the resistance to deposit formation as measured by the Vapor Phase Coker Test at 700° F. of the turbine oil is at least 30 mg lower than the deposit formation of turbine oils containing the same ester base stock and aminic antioxidant. but containing tricresyl phosphate in place of the RDP.

DETAILED DESCRIPTION

All numerical values within the detailed description and the claims herein are modified by "about" or "approximately" the indicated value, and take into account experimental error and variations that would be expected by a person having ordinary skill in the art.

The present disclosure is directed to a method for maintaining or enhancing the antiwear performance as specified in SAE specification AS 5780 of High Performance Category (HPC) turbine oils, especially gas turbine oils, particularly aviation turbine oils or jet engine oils containing polymerized amine antioxidants and to such turbine oils themselves and to a method for improving the deposit formation resistance performance of turbine oils containing monomeric aminic antioxidants (Standard Performance Category (SPC) turbine oils), or polymeric aminic antioxidants (HPC turbine oils).

Turbine oils in general are made up of a number of components which include the base oil, which is one or a mixture of synthetic esters such as polyol esters and diesters, antioxidants, antiwear agents, friction reducers, corrosion inhibitors, metal passivators, dispersants, and defoamants.

As the demands on the turbine oil increase in terms of load and temperature, HPC turbine oils are being formulated containing polymeric amine antioxidants to enhance oxidation stability. Most SPC oils contain monomeric amine antioxidants and most HPC oils contain polymeric amine antioxidant However, it is desirable to not only improve the oxidation stability of such oils but to maintain and, if possible, enhance the load-bearing capacity and deposit formation resistance performance of such turbine oils.

The present disclosure is a method for maintaining or enhancing the antiwear/load-bearing performance of High Performance Category turbine oil containing polymeric amine antioxidant additives and phosphate-type antiwear agents and to a method for improving the deposit formation resistance performance of Standard Performance Category turbine oil containing monomeric amine antioxidant and phosphate ester-type antiwear agents and of High Performance Category turbine oils containing polymeric amine antioxidants and phosphate ester-type antiwear agents by using as the antiwear agent an additive amount of a polyphosphate ester antiwear agent including resorcinol bis(diphenylphosphate) of the formula:

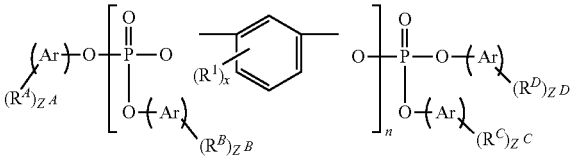

wherein $R^1$ is a $C_1$ to $C_5$ alkyl group, x is an integer ranging from zero to 4, preferably zero to 2, more preferably zero, n is an integer ranging from 1 to 7, each Ar is independently phenyl or naphthyl, $R^A$, $R^B$, $R^C$ and $R^D$ are the same or different, selected from the group consisting of hydrogen, $C_1$ to $C_{18}$ alkyl groups, preferably hydrogen and $C_1$ to $C_5$ alkyl groups, and when any of $R^A$ to $R^D$ are other than hydrogen the corresponding $Z^A$, $Z^B$, $Z^C$ and $Z^D$ are the same or different, preferably the same, and range from 1 to up to the available valence of each Ar group, preferably 1 to 2, most preferably 1. The resorcinol bis(diphenylphosphate) additive will be designated herein as RDP.

The RDP is used in an amount in the range 0.01 to 10 wt % (active ingredient), preferably 0.1 to 5 wt % (active ingredient), more preferably 1 to 4 wt % (active ingredient), contributing from 500 to 6000 ppm phosphorus, preferably 1000 to 4000 ppm phosphorus, to the formulation.

The present disclosure is also directed to the HPC lubricant comprising the synthetic ester base stock, polymeric aminic antioxidant and the RDP antiwear additive.

It has been discovered that by replacing all or a portion, preferably all, of other phosphate-type antiwear agents such as the tri-cresyl phosphate currently used in turbine oils with RDP, when the antioxidant is one or more of a polymeric aminic antioxidant, the antiwear performance of the turbine oil is maintained or even enhanced as compared to the antiwear performance exhibited by turbine oils containing other phosphate-type antiwear additives such as tri-cresyl phosphate, tri(tert-butyl phenyl)-phosphate or even IDP (4,4'-(isopropylidenediphenyl)bis(diphenyl phosphate), wherein the antiwear performance of such oils is degraded when the antioxidant is changed from monomeric aminic antioxidants to a polymeric aminic antioxidant. The deposit formation resistance performance of such oil is also superior to that of turbine oils containing the same ester base stock and polymeric aminic antioxidant but containing tricresyl phosphate in place of the RDP. In the Vapor Phase Coker Test at 700° F., the deposit formation resistance performance of HPC turbine oils containing RDP is 30 mg lower, or 40 mg lower, or 50 mg lower, or 60 mg lower, or 70 mg lower, that is better, than the performance of turbine oils containing the same ester base stock and polymeric aminic antioxidant but containing tricresyl phosphate in place of the RDP.

It has also been discovered that the deposit formation resistance performance of turbine oils containing monomeric aminic antioxidant can also be improved by employing RDP, the deposit formation resistance performance being improved compared to the deposit formation performance exhibited by turbine oils containing the same base stock and monomeric aminic antioxidant but containing tricresyl phosphate in place of the RDP. The improvement is seen as a reduction in the deposits formed by at least 40 mg, or at least 60 mg, or at least 80 mg, or at least 100 mg, or at least 130 mg, compared to turbine oils containing the same ester base stock and monomeric aminic antioxidant but tricresyl phosphate in place of the RDP.

The antiwear performance of the turbine engine oils disclosed herein may be measured using the Wedeven Associates Machine (WAM) test, which is a required test for qualification of a turbine (jet) engine oil (scuffing load stage limit>=15). The WAM test is described in details in the Examples section below. The turbine engine oils disclosed herein yield WAM test values ranging from greater than 23 to 30, or greater than 24 to 30, or greater than 25 to 30, or greater than 26 to 30, or greater than 27 to 30.

Alternatively, the antiwear performance of the turbine engine oils disclosed herein may be measured using the 4-ball wear using ASTM D4172 as the screener test. The 4-ball wear test is described in details in the Examples section below. The turbine engine oils disclosed herein yield 4-ball wear test results of less than 0.55, or less than 0.50, or less than 0.45, or less than 0.40, or less than 0.35, or less than 0.30.

Turbine oils, e.g. gas turbine oils, aviation turbine oils and jet engine turbine oils, employ synthetic esters and especially polyol esters as base oils.

The synthetic ester which can be used as the base oil is formed by the esterification of an aliphatic monohydric or polyhydric alcohol with linear or branched carboxylic acids.

The synthetic esters employed as base oils for the turbine oil have kinematic viscosities at 100° C. in the range of 2 to 12 $mm^2/s$, preferably 3 to 8 $mm^2/s$, more preferably 4 to 6 $mm^2/s$.

Monohydric alcohols suitable for making ester base stocks include methyl, butyl, isooctyl, didecyl and octadecyl alcohols. "Oxo" alcohols prepared by the reaction of olefins with carbon monoxide and hydrogen are suitable. Neo-alcohols, i.e., alcohols having no hydrogens on the beta carbon atom, are preferred. Examples of such alcohols are 2,2,4-trimethylpentanol and 2,2-dimethyl propanol.

The polyhydric alcohols which can be reacted with the linear acid are, by way of example, polyols represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term "carbon number" as used throughout this application refers to the total number of carbon atoms in either the acid or alcohol as the case may be) and number of hydroxyl groups contained in the polyhydroxyl compound used to form the carboxylic esters may vary over a wide range.

The following alcohols are particularly useful as polyols: 2-ethyl-1,3-hexanediol, 2-propyl-3,3-heptanediol, 2-butyl-1,3-butanediol, 2,4-dimethyl-1,3-butanediol, neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol and polyalkylene glycols (e.g., polyethylene glycols, polypropylene glycols, polybutylene glycols, etc., and blends thereof such as polymerized mixture of ethylene glycol and propylene glycol). Mixtures of such alcohols may also be used.

The carboxylic acid reactant used to produce the synthetic polyol ester base oil is selected from aliphatic monocarboxylic acids or a mixture of aliphatic monocarboxylic acids and aliphatic dicarboxylic acids. The carboxylic acids contain from 4 to 20 carbon atoms and includes the straight and branched chain aliphatic acids. The aliphatic chain may include aryl substituents. Mixtures of acids may be used.

The carboxylic acid used is a branched or linear $C_4$ to $C_{20}$ carboxylic acid.

The branched acid is preferably a mono-carboxylic acid which has a carbon number in the range between about $C_4$ to $C_{20}$, more preferably about $C_5$ to $C_{10}$ wherein methyl or ethyl branches are preferred. The mono-carboxylic acid is preferably at least one acid selected from the group consisting of: 2,2-dimethylpropionic acid (neopentanoic acid), neoheptanoic acid, neooctanoic acid, neononanoic acid, isohexanoic acid, neodecanoic acid, 2-ethylhexanoic acid (2EH), 3,5,5-trimethylhexanoic acid (TMH), isoheptanoic acid, isooctanoic acid, isononanoic acid and isodecanoic acid. One especially preferred branched acid is 3,5,5-trimethylhexanoic acid. The term "neo" as used herein refers to a trialkyl acetic acid, i.e. an acid which is triply substituted at the alpha carbon with alkyl groups. These alkyl groups are equal to or greater than $CH_3$, as shown in the general structure set forth herebelow:

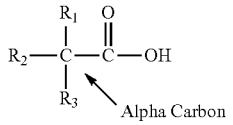

wherein $R_1$, $R_2$ and $R_3$ are greater than or equal to $CH_3$ and not equal to hydrogen.

3,5,5-trimethylhexanoic acid has the structure set forth herebelow:

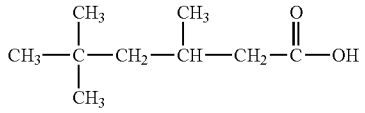

The mono-carboxylic linear acids are any linear saturated alkyl carboxylic acid having a carbon number in the range between about $C_4$ to $C_{20}$, preferably $C_5$ to $C_{10}$.

Some examples of linear acids include butyric, valeric, sebacic, azelaic, suberic, succinic, adipic, oxalic, malonic, glutaric, pentadecanedicarboxylic, diglycolic, thidiglycolic, acetic, propionic, lauric, palmitic, pimilic, n-hexanoic, n-heptanoic, n-octanoic, n-nonanoic, and n-decanoic acids and mixtures thereof.

Examples of suitable ester base oils are ethyl palmitate, ethyl laurate, butyl stearate, di-(2-ethylhexyl)sebacate, di(2-ethylhexyl)azealate, ethyl glycol dilaurate, di-(2-ethylhexyl) phthalate, di-(1,3-methylbutyl)adipate, di-(1-ethylpropyl) azelate, diisopropyloxylate, dicyclohexyl sebacate, glycerol tri-n-heptoate, di(undecyl)azelate, and tetraethylene glycol di-(2-ethyl caproate), and mixtures thereof.

If it is desired to form a complex alcohol ester or complex acid ester, then the synthetic ester can also include a polybasic acid selected from the group consisting of: any $C_2$ to $C_{12}$ polybasic acids, e.g. adipic, azelaic, sebacic and dodecanedioic acids.

Other preferred polyol ester base oils are those ones prepared from technical pentaerythritol and a mixture of linear and branched $C_4$ to $C_{20}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula:

I

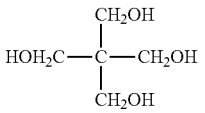

and about 12% of dipentaerythritol having the formula:

II

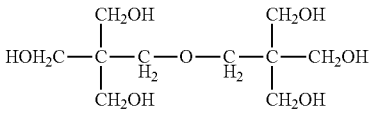

The technical pentaerythritol may also contain some tri- and tetrapentaerythritol that is normally formed as by-products during the manufacture of technical pentaerythritol.

The preparation of esters from alcohols and carboxylic acids can be accomplished using conventional methods and techniques known and familiar to those skilled in the art. In general, the monohydric alcohol or polyhydric alcohol, e.g. technical pentaerythritol, is heated with the desired carboxylic acid or mixture of acids either neat or in the presence of a solvent such as an aromatic hydrocarbon and optionally in the presence of catalyst such as, e.g. titanium, zirconium and tin catalysts such as titanium, zirconium or tin alcohalates, carboxylates and chelates, HCl, HF, HBr, $H_2SO_4$, $BF_3$, etc., see for example U.S. Pat. No. 3,038,859 and U.S. Pat. No. 3,121,109.

Generally, a slight excess of acid is employed to force the reaction to completion to produce a fully esterified product. Water is removed during the reaction and any excess acid is then stripped from the reaction mixture. The esters of technical pentaerythritol may be used without further purification or may be further purified using conventional techniques such as distillation or other methods known to those of skill in the art.

Other polyol esters useful as turbine oil base oils are those made by synthesizing the polyol esters from a polyol and a branched or linear carboxylic acid in such a way that it has a substantial amount of unreacted hydroxyl groups; that is, the product is not fully esterified. The presence of the unreacted hydroxyl group in the ester is believed to allow this "high" hydroxyl ester to exhibit increased thermal/oxidation stability, as measured by high pressure differential scanning calorimetry (HPDSC). It is believed the presence of the unreacted hydroxyl group provides a pathway capable of scavenging alkoxide and alkyl peroxide radicals formed in the turbine oil during use, such scavenging thereby reducing the rate at which oxidation degradation can occur.

The high hydroxyl polyester is the reaction product of a linear or branched alcohol and at least one branched and/or linear carboxylic acid, the resulting synthetic ester having a hydroxyl number between 5 to 180 depending on the acid and polyol used (e.g. 1 to 25% unconverted hydroxyl groups, based on the total amount of hydroxyl groups in the branched or linear alcohol), preferably between about 5 to 100 (e.g. 1 to 15% unconverted hydroxyl groups), more preferably between 10 to 80 (e.g. 2 to 10% unconverted hydroxyl groups).

Hydroxyl number measures the free hydroxyl groups by determining the amount of acetic anhydride that the sample will react with under certain conditions. Anhydride is introduced in excess with the sample. Once the reaction is complete, the remaining anhydride is determined by titration with a base solution. The hydroxyl number is reported as milligrams of KOH/gram of sample. A standard method for measuring hydroxyl number is detailed by the American Oil Chemist's Society as A.O.C.S. Cd. 13-60. For highly converted esters, e.g. 99% or more conversion to ester (almost no unreacted hydroxyl groups), the hydroxyl number is generally less than or equal to 5.

In the case of both the fully esterified ester and the ester containing free hydroxyl groups, the alcohols and acids employed can be the same, the only difference in the products being, as previously indicated, that in one instance the product is fully esterified and in the other the product has free hydroxyl groups.

Mixtures of fully esterified synthetic esters and of synthetic esters containing free hydroxyl groups can also be used.

Esters suitable for use as base stocks for turbine oils are esters of monocarboxylic acids having three to twelve carbons and polyalcohols such as pentaerythritol, dipentaerythritol and trimethylolpropane. Examples of these esters are pentaerythrityl tetrabutyrate, pentaerythrityl tetravalerate, pentaerythrityl tetracaproate, pentaerythrityl dibutyratedicaproate, pentaerythrityl butyratecaproate divalerate, pentaerythrityl butyrate trivalerate, pentaerythrityl butyrate tricaproate, pentaerythrityl tributyratecaproate, mixed $C_4$- to $C_{10}$-saturated fatty acid esters of pentaerythritol, dipentaerythrityl hexavalerate, dipentaerythrityl hexacaproate, dipentaerythrityl hexaheptoate, dipentaerythrityl hexacaprylate, dipentaerythrityl tributyrate tricaproate, dipentaerythrityl trivalerate trinonylate, dipentaerythrityl mixed hexaesters of $C_4$ to $C_{10}$ fatty acids and trimethylolpropane heptylate. Pentaerythrityl esters of mixtures of $C_4$ to $C_{12}$ acids are excellent base oils and are commercially available from Hercules Chemical Company.

If desired the synthetic esters, e.g. fully esterified and/or esters containing free hydroxyl groups, can be further used with other base stocks such as mineral oil, highly refined mineral oil, polyalpha olefins, polyalkylene glycols, phosphate esters, silicone oils, other polyol esters, as well as hydrocarbon oils made by hydrodewaxing/hydroisomerizing waxy feeds such as hydrodewaxed/hydroisomerized slack wax or Fischer-Tropsch synthesis waxes.

It is preferred, however, that the synthetic ester be it a fully esterified material or an ester containing free hydroxyl groups either be used individually or only in the mixture of two or more esters.

Monomeric amine antioxidants are unsubstituted or hydrocarbon-substituted diphenyl amines, unsubstituted or hydrocarbyl-substituted phenyl naphthyl amines and unsubstituted or hydrocarbyl-substituted phenothiazines wherein the hydrocarbyl-substituted group is styrene or a $C_1$ to $C_{30}$ alkyl group, preferably a $C_1$ to $C_{10}$ alkyl group, more preferably a $C_4$ to $C_{10}$ alkyl group. Other monomeric aryl amines have been described in the patent literature.

Polymeric amine antioxidants are the polymerization reaction products of one or more substituted or hydrocarbyl-substituted diphenyl amines, one or more unsubstituted or hydrocarbyl-substituted phenyl naphthyl amines or both one or more of unsubstituted or hydrocarbyl-substituted diphenylamine with one or more unsubstituted or hydrocarbyl-substituted phenyl naphthylamine. A representative schematic is presented below:

(a)

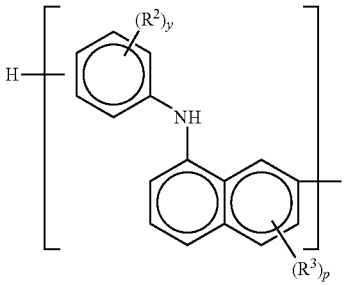

and (b)

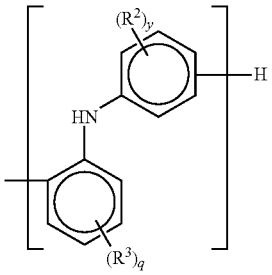

wherein (a) and (b) each range from zero to 10, preferably zero to 5, more preferably zero to 3, most preferably 1 to 3, provided (a)+(b) is at least 2; for example:

(A)

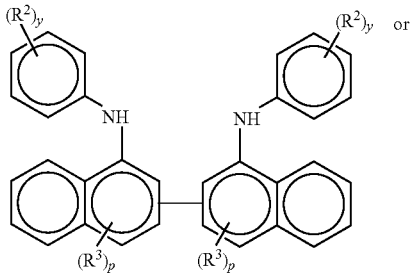

(B)

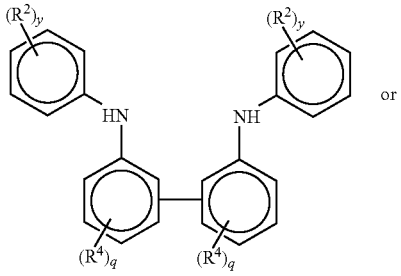

-continued (C)

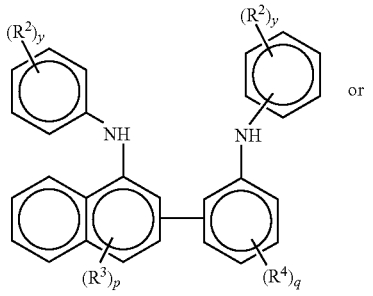

(D)

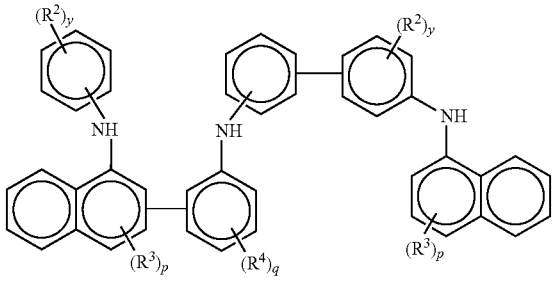

wherein $R^2$ is a styrene or $C_1$ to $C_{30}$ alkyl, $R^3$ is a styrene or $C_1$ to $C_{30}$ alkyl, $R^4$ is a styrene or $C_1$ to $C_{30}$ alkyl, preferably $R_2$ is a $C_1$ to $C_{30}$ alkyl, $R_3$ is a $C_1$ to $C_{30}$ alkyl, $R_4$ is a $C_1$ to $C_{30}$ alkyl, more preferably $R_2$ is a C4 to C10 alkyl, $R_3$ is a C4 to C10 alkyl and $R_4$ is a C4 to C10 alkyl, p, q and y individually range from 0 to up to the valence of the aryl group to which the respective R groups are attached, preferably at least one of p, q and y range from 1 to up to the valence of the aryl group to which the respective R group(s) are attached, more preferably p, q and y each individually range from at least 1 to up to the valence of the aryl group to which the respective R groups are attached.

Other more extensive oligomers are within the scope of this disclosure, but materials of formulae A, B, C and D are preferred.

The polymeric amine antioxidant may contain nonpolymerized aryl amine antioxidant starting materials as a result of the preparation procedure. Additional monomeric amine antioxidants may be added to the lubricant to impart desired properties. Examples of monomeric amine antioxidants include but are not limited to diphenyl amine, alkylated diphenyl amines, styrenated diphenyl amines, phenyl-N-naphthyl amine, alkylated phenyl-N-naphthyl amines, styrenated phenyl-N-naphthyl amines, phenothiazine, alkylated phenothiazine, and styrenated phenothiazine. Other antioxidants such as hindered phenols and zinc dithiophosphates can also be added to the lubricant in addition to the polymerized amine antioxidant.

The polymeric amine antioxidant is present in an amount in the range 0.5 to 10 wt % (active ingredient), preferably 2 to 5 wt % (active ingredient) of polymerized aminic antioxidant exclusive of any unpolymerized aryl amine which may be present or any added antioxidants.

The method for maintaining or enhancing the antiwear performance of a turbine oil and improving the deposition formation resistance performance of a turbine oil containing polyol ester base stock and polymeric amine antioxidant is the use of a RDP antiwear additive of the formula:

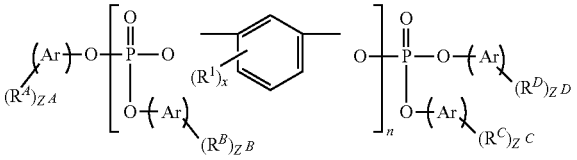

wherein $R^1$ is a $C_1$ to $C_5$ alkyl group, x is an integer ranging from zero to 4, preferably zero to 2, more preferably zero, n is an integer ranging from 1 to 7, each Ar is independently phenyl or naphthyl, $R^A$, $R^B$, $R^C$ and $R^D$ are the same or different $C_1$ to $C_{18}$ alkyl groups, preferably hydrogen and $C_1$ to $C_5$ alkyl groups, and $Z^A$, $Z^B$, $Z^C$ and $Z^D$ are the same or different, preferably the same, and range from 1 to up to the available valence of each Ar group, preferably 1 to 2, most preferably 1.

The RDP is used in an amount in the range 0.01 to 10 wt % (active ingredient), preferably 0.1 to 5 wt % (active ingredient), more preferably 1 to 4 wt % (active ingredient), contributing from 500 to 6000 ppm phosphorus, preferably 1000 to 4000 ppm phosphorus to the formulation.

The RDP can be employed in combination with the standard, typical antiwear additive such as tri-cresyl phosphate, tri(tert-butyl phenyl) phosphate and even IDP, but it is preferred that the RDP be used as a total replacement of any such other antiwear additives.

RDP not only exhibits enhanced antiwear performance/antiwear performance retention in the presence of polymeric amine antioxidant, which the other antiwear additives don't, but the published literature also indicates it is not toxic, see e.g. Henrich, R. et al., "Two Generation Oral (Diet) Reproductive Toxicity Study of Resorcinol Bis-Diphenylphosphate (Fyrolflex RDP) in Rats", International Journal of Toxicology, 19: 243-255, 2000; Ryan, B. M. et al., "Development Toxicity Study of Orally Administered Resorcinol Bis-Diphenylphosphate (RDP) in Rats", International Journal of Toxicology, 19: 257-264, 2000; Sherwood, R. L. et al., "Immunotoxicity Evaluation of Resorcinol Bis-Diphenylphosphate (Fyrolflex RDP) in B6 C3F1 Mice", International Journal of Toxicology, 19: 265-275, 2000; Henrich, T. et al., "Twenty-Eight Day Nose-Only Inhalation Study of Resorcinol Bis-Diphenylphosphate (Fyrolflex RDP) in Rats", International Journal of Toxicology, 19: 223-231; and Freudenthal, R. I. et al., "Comparative Metabolism and Toxicokinetics of $^{14}C$-Resorcinol Bis-Diphenylphosphate (RDP) in the Rat, Mouse and Monkey", International Journal of Toxicology, 19: 233-242, 2000.

The turbine oils benefited by the present method include turbine oils further containing additive amounts of any of the additives common to turbine oil formulations including by way of example and not limitation corrosion inhibitors such as combinations of one or more dicarboxylic acids and a linear or branched alkyl or alkenyl succinic acid/anhydride ester or hemiester or hydroxylated derivative of such esters or hemiesters or linear or branched alkyl or alkenyl-substituted succinimides or amino-substituted succinimides, as well as other antioxidants including phenolic and monomeric aminic antioxidants, extreme pressure additives, antifoamants, detergents, hydrolytic stabilizers, metal deactivators, rust inhibitors, colorants, odorants, deodorants, viscosity modifiers, viscosity index improvers, etc. as desired by the practitioner.

The following are examples of the present disclosure and are not to be construed as limiting.

EXAMPLES

The different phosphate esters evaluated in the following Examples are presented below in Table 1:

TABLE 1

| | |
|---|---|
| RDP<br>n = 1 to 7 | 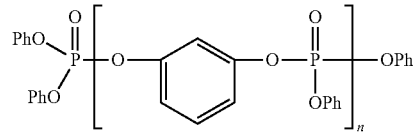 |
| IDP<br>n = 1 to 7 | 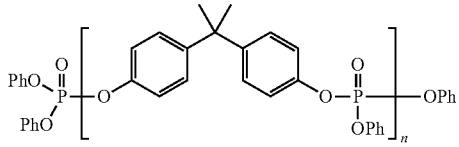 |
| t-Bu-TPP with varying amount of unbutylated triphenyl phosphate (TPP) | 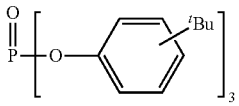 |
| Tricresyl Phosphate (TCP) | 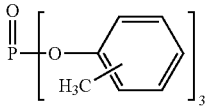 |
| Trixylyl Phosphate (TXP) | 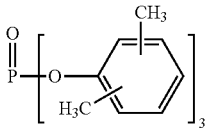 |

The polyol ester oils used as base stocks in the formulations evaluated in the following Example are presented and identified below in Table 2:

TABLE 2

| |
|---|
| Jet Ester 1:<br>PE/di-PE ester of i-$C_5$, n-$C_5$, $C_7$, $C_8$ and $C_{10}$ acids |
| Jet Ester 2:<br>PE/di-PE ester of i-$C_5$, n-$C_5$, $C_7$ and $C_9$ acids |
| Jet Ester 3:<br>PE/di-PE ester of n-$C_5$, n-$C_7$, $C_8$ and $C_{10}$ acids |

wherein PE/di-PE means technical grade pentaerythritol containing a mixture of mono-pentaerythritol and di-pentaerythritol.

Three different polymeric amine antioxidants were evaluated for their effect on WAM performance in the Examples presented. The specific polymeric amine antioxidant used is identified in each Example.

Two of the three polymeric amine antioxidants were prepared according to the teachings of U.S. Pat. No. 3,573,206. Polymeric Antioxidant 1 and polymeric Antioxidant 2 were prepared by combining $C_8$-alkylated phenyl-α-naphthylamine and dioctyldiphenyl amine in a 3-to-2 ratio oligomerized to different degrees through the use of various amounts of alkyl peroxide. Polymeric Antioxidant 3 is a polymerized aryl amine commercially available from R. T. Vanderbilt as Vanlube 9317. The treat rates of the antioxidants were adjusted based on the variations in percent active ingredient of the antioxidants to achieve an active ingredient treat level in each formulation of 2.8 wt % (active ingredient).

Two series of turbine engine oils were formulated, one series being a Standard Performance Category (SPC) turbine (jet) engine oil and the second being a High Performance Category (HPC) turbine (jet) engine oil.

The definitions and criteria for certification of commercial jet oils as SPC and HPC are given in the SAE specification AS5780. This specification defines basic physical, chemical and performance limits for 5 cSt grades of gas turbine engine lubricating oils used in aero- and aero-derived marine and industrial applications, along with standard test methods and requirements for laboratories performing them. It also defines the quality control requirements to assure batch conformance and materials traceability, and the procedures to manage and communicate changes in oil formulation and brand.

These two series of turbine (jet) engine oils are provided in Table 3 and Table 4:

Because the additive being replaced is an antiwear additive, the antiwear performance of the turbine engine oils was determined using the Wedeven Associates Machine (WAM) which is a required test for qualification of a turbine (jet) engine oil (scuffing load stage limit>=15).

The WAM test employs a ball-on-disk machine that undergoes a progressive loading until a scuffing failure occurs in the lubricated contact zone. Test conditions are selected to mimic the loading and roll-to-slide ratios encountered in the Ryder Gear Test described in Federal Test Method Standard 791C, Methods of Testing Lubricants, Liquid Fuels, and Related Products; Test Method 6508 Load-Carrying Capacity

TABLE 3

Standard Performance Category (SPC) Turbine (Jet) Oils

| Component, wt % | Blend 1 | Blend 2 | Blend 3 | Blend 4 | Blend 5 | Blend 6 | Blend 7 |
|---|---|---|---|---|---|---|---|
| Jet Ester 1 | 95.515 | 95.225 | 94.675 | 94.585 | 94.865 | 95.015 | 94.845 |
| Monomeric Amine Antioxidants | 2 | 2 | 2 | 2 | 2 | 2 | 2 |
| Metal passivators | 0.145 | 0.145 | 0.145 | 0.145 | 0.145 | 0.145 | 0.145 |
| Defoamant | 0.01 | 0.01 | 0.01 | 0.01 | 0.01 | 0.01 | 0.01 |
| A: RDP | 2.33 | — | — | — | — | — | — |
| B. IDP | — | 2.62 | — | — | — | — | — |
| C. Butylated triphenyl phosphate of which 11.8% is TPP | — | — | 3.17 | — | — | — | — |
| D. Butylated triphenyl phosphate of which 6.6% is TPP | — | — | — | 3.26 | — | — | — |
| E. Butylated triphenyl phosphate of which 4.2% is TPP | — | — | — | — | 2.98 | — | — |
| F. 82% TCP/18% TXP | — | — | — | — | — | 2.83 | — |
| G. Durad 125 (TCP) | — | — | — | — | — | — | 3 |
| Phosphorus (ppm) | 2590 | 2310 | 2370 | 2350 | 2410 | 2470 | 2430 |
| WAM | 28.6 | 29 | 25.6 | 23.6 | 27.6 | 27.25 | 26.6 |
| Oxidation & Corrosion Viscosity Increase at 218 C. | 42.3 | 64.2 | 66.0 | 66.0 | 91.8 | 87.3 | 68.7 |
| Oxidation & Corrosion Viscosity TAN at 218 C. | 7.38 | 9.38 | 9.34 | 8.2 | 12.06 | 11.88 | 10.42 |
| VPC at 700 F., mg deposits | 178.6 | 152.4 | 244.0 | 182.1 | 163.5 | 248.8 | 219.8 |
| TFO, 625 F., merits | 95.5 | 97.4 | 94.8 | 90.7 | 92.6 | 91.5 | 95.3 |

TABLE 4

High Performance Category (HPC) Turbine (Jet) Oils

| Component, wt % | Blend A | Blend B | Blend C | Blend D | Blend E | Blend F | Blend G |
|---|---|---|---|---|---|---|---|
| Jet Ester 1 | 91.13 | 90.84 | 90.39 | 90.32 | 90.55 | 90.67 | 90.53 |
| Polymeric Antioxidant 1 | 7 | 7 | 7 | 7 | 7 | 7 | 7 |
| Metal Passivator | 0.06 | 0.06 | 0.06 | 0.06 | 0.06 | 0.06 | 0.06 |
| Defoamant | 0.01 | 0.01 | 0.01 | 0.01 | 0.01 | 0.01 | 0.01 |
| A: RDP | 1.87 | — | — | — | — | — | — |
| B. IDP | — | 2.09 | — | — | — | — | — |
| C. Butylated triphenyl phosphate of which 11.8% is TPP | — | — | 2.54 | — | — | — | — |
| D. Butylated triphenyl phosphate of which 6.6% is TPP | — | — | — | 2.61 | — | — | — |
| E. Butylated triphenyl phosphate of which 4.2% is TPP | — | — | — | — | 2.38 | — | — |
| F. 82% TCP/18% TXP | — | — | — | — | — | 2.26 | — |
| G. Durad 125 (TCP) | — | — | — | — | — | — | 2.4 |
| Phosphorus (ppm) | 1870 | 1870 | 1910 | 1790 | 1810 | 1830 | 1990 |
| WAM | 29.3 | 23 | 21.7 | 22.3 | 22.7 | 22.7 | 22.2 |
| Oxidation & Corrosion Viscosity Increase at 218 C. | 13.0 | 26.8 | 20.7 | 26.2 | 28.7 | 19.7 | 18.1 |
| Oxidation & Corrosion Viscosity TAN at 218 + A2C | 3.32 | 4.14 | 5.42 | 6.29 | 6.36 | 1.84 | 1.54 |
| VPC at 700 F., mg deposits | 146.7 | 138.2 | 131.9 | 186.7 | 115.1 | 143.6 | 163.5 |
| TFO, 655 F., merits | 98.1 | 93.9 | 98.2 | 98.4 | 92.8 | 94.8 | 93.7 |
| D4172, 4-ball wear scar diameter, mm | 0.36 | 0.44 | 0.54 | 0.51 | 0.54 | 0.51 | 0.60 |

of Lubricating Oils (Ryder Gear Machine). The test equipment and procedure, which were employed and followed in conducting the following examples, are described in Aerospace Information Letter (AIR) 4978, *Temporary Methods for Assessing the Load Carrying Capacity of Aircraft Propulsion System Lubricating Oils*. The paper is available from the Society of Automotive Engineers.

As shown in Table 3, the WAM for the SPC turbine oil containing RDP (A) and the IDP (B) in combination with monomeric amine antioxidant outperformed the three formulations containing butylated triphenyl phosphate, as well as the two formulations containing tri-cresyl phosphate.

In Table 4, the WAM results for the HPC turbine oil shows, however, that whereas in the HPC turbine oil which contains a polyamine antioxidant, the antiwear performance of the IDP formulation, of the three butylated triphenyl phosphate formulations and the two tricresyl phosphate formulations were all lower than for SPC turbine oils containing comparable phosphate in a monoamine antioxidant formulation, unexpectedly the HPC turbine oil formulation containing the RDP in combination with polymeric aminic antioxidant exhibited a WAM load stage rating not only higher than that of the other HPC formulations but also higher than that of the SPC turbine oil similarly containing the RDP antiwear additive but in combination with the monomeric amine antioxidant.

Testing has shown the reproducibility of the WAM test to be +/− approximately 1.5 load stages.

The O&C test results in Tables 3 and 4 were obtained using test FTM 5308 at 218° C.

Table 3 demonstrates that of the SPC turbine oil formulations the formulation containing RDP exceeded all others in terms of resistance to viscosity increase and tan increase.

Table 4 shows that of the HPC turbine oils, the formulation containing RDP (Blend A) exhibited lower viscosity and TAN increase than any of the other formulations except for Blends F and G, which contained tricresyl phosphate.

The VPC test results for Tables 3 and 4 were obtained using the Vapor Phase Coker (VPC) test at 700° F.

The VPC Test is described in Aerospace Recommended Practice (ARP) 5921 *Vapor Phase Coking*. This ARP, still in draft form, is available from Mr. James McDonnell, Fuel & Lubricants Division, Naval Air Systems Command, 22229 Elmer Road, Patuxent River, Md. 20670, U.S.A.

Tables 3 and 4 both show that the formulations containing RDP exhibited results superior to that of the reference turbine oils which contained tricresyl phosphate antiwear additive.

Tables 3 and 4 compare the Thin Film Oxidation results for seven SPC turbine oils and for seven HPC turbine oils. The Thin Film Oxidation Test is described in *Deposit Forming Tendencies of High-Temperature Lubricants*, E. A. Oberright, S. J. Leonard and H. L. Hepplewhite, ASLE Transations 1964 7(1), 64-72. As can be seen, of the HPC turbine oil formulations tested the formulations containing the RDP met or exceeded the oxidation performance of the other formulations.

Table 4 presents the 4-ball wear test results for the HPC turbine oils. The 4-ball wear test results were secured using ASTM D4172 as the screener test. While all formulations exceeded the performance of Blend G which employed conventional commercial tricresyl phosphate, again the formulation containing the RDP greatly exceeded the performance of the other formulations.

In Table 5 the effect, if any, of different ester base stocks on the WAM performance of formulated oils containing RDP and polymeric aminic antioxidant was determined. It was found that the identity of the ester base stock does not materially affect WAM results.

TABLE 5

| Component (wt %) | Ester 1 | Ester 2 | Ester 3 |
|---|---|---|---|
| Jet Ester 1 | 91.06 | | |
| Jet Ester 2 | | 91.06 | |
| Jet Ester 3 | | | 91.06 |
| Antioxidant 1 | 7 | 7 | 7 |
| Metal Passivators | 0.06 | 0.06 | 0.06 |
| Defoamant | 0.01 | 0.01 | 0.01 |
| RDP | 1.87 | 1.87 | 1.87 |
| Phosphorus (ppm) | 2060 | 2020 | 2050 |
| WAM | 28.25 | 30 | 27 |

Table 6 investigates the effect, if any, that different polymeric aminic antioxidants have on the WAM performance of formulated oils containing RDP:

TABLE 6

| Component, wt % | Antioxidant 1 | Antioxidant 2 | Antioxidant 3 |
|---|---|---|---|
| Jet Ester 1 | 91.06 | 91.06 | 92.46 |
| Antioxidant 1 | 7 | | |
| Antioxidant 2 | | 7 | |
| Antioxidant 3 | | | 5.6 |
| Metal Passivators | 0.06 | 0.06 | 0.06 |
| Defoamant | 0.01 | 0.01 | 0.01 |
| RDP | 1.87 | 1.87 | 1.87 |
| Phosphorus (ppm) | 2050 | 2020 | 2010 |
| WAM | 27 | 27.75 | 26.25 |

From Table 6 it is seen that the type of polymeric aminic antioxidant used in the formulation does not materially affect the WAM results.

Table 7 presents the compositional profiles and deposit formation resistance performance as determined by VPC testing of HPC turbine oils made using different polyol ester base oils in combination with polymeric aminic antioxidants and RDP compared to turbine oils containing the same ester base stocks and antioxidants but containing tricresyl phosphate in place of the RDP.

TABLE 7

| Component, wt % | Blend $X_A$ | Blend $X_B$ | Ref. X | Blend $Y_A$ | Blend $Y_B$ | Blend $Y_C$ | Ref. Y |
|---|---|---|---|---|---|---|---|
| Jet Ester 2 | | | | 88.19 | 87.61 | 87.03 | 86.94 |
| Jet Ester 3 | 91.53 | 90.6 | 90.53 | | | | |
| Polymeric Antioxidant$_1$ | 7 | 7 | 7 | | | | |
| Polymeric Antioxidant$_2$ | | | | 10 | 10 | 10 | 10 |
| Metal Passivator | 0.06 | 0.06 | 0.06 | 0.05 | 0.05 | 0.05 | 0.05 |
| Defoamant | 0.01 | 0.01 | 0.01 | 0.01 | 0.01 | 0.01 | 0.01 |
| RDP | 1.4 | 2.33 | | 1.75 | 2.33 | 2.91 | |
| Durad 125 (TCP) | | | 2.4 | | | | |

TABLE 7-continued

| Component, wt % | Blend $X_A$ | Blend $X_B$ | Ref. X | Blend $Y_A$ | Blend $Y_B$ | Blend $Y_C$ | Ref. Y |
|---|---|---|---|---|---|---|---|
| Durad 120XC (TCP/TXP) | | | | | | | 3 |
| Phosphorus (ppm) | 1600 | 2640 | 2010 | 2040 | 2650 | 3280 | 2530 |
| VPC at 700 F., mg deposits | 81.9 | 76.5 | 121.2 | 132.6 | 157.6 | 154.2 | 203.9 |

The different blends contained different amounts of RDP. The amounts of RDP added to blends $X_A$ and $X_B$ were sufficient to provide amounts of phosphorus equal to 75% (Blend $X_A$) and 125% (Blend $X_B$) of the amount of phosphorus contained in Ref X contributed by the Durad 125 (TCP). Blends $Y_A$, $Y_B$ and $Y_C$, respectively contained sufficient RDP to provide amounts of phosphorus equal to 75% (Blend $Y_A$), 100% (Blend $Y_B$) and 125% (Blend $Y_C$) of the amount of phosphorus contained in Ref Y contributed by the Durad 120XC (TCP/TXP). From Table 7 it is seen that the different blends containing the RDP exhibited from about 40 to 70 mg less deposits in the VPC test than the TCP-containing formulations.

Table 8 presents the compositional profile and deposit formation resistance performance of SPC turbine oils made using Jet Ester 1 in combination with a monomeric aminic antioxidant and RDP compared to turbine oil containing the same ester base stock and antioxidant but containing tricresyl phosphate in place of the RDP.

TABLE 8

| Component, wt % | Blend $Z_A$ | Blend $Z_B$ | Ref. Z |
|---|---|---|---|
| Jet Ester 1 | 96.09 | 94.93 | 94.84 |
| Monomeric Antioxidant | 2 | 2 | 2 |
| Metal Passivator | 0.15 | 0.15 | 0.15 |
| Defoamant | 0.01 | 0.01 | 0.01 |
| RDP | 1.75 | 2.9 | |
| Durad 120XC (TCP/TXP) | | | 3 |
| Phosphorus (ppm) | 1750 | 2940 | 2570 |
| VPC at 700 F., mg deposits | 91.6 | 75.8 | 209.7 |

It is seen that the amounts of RDP added to the different blends in Table 8 varied from blend to blend. The amount of RDP added to Blend $Z_A$ was an amount sufficient to provide an amount of phosphorus equal to 75% of the amount of phosphorus contained in Ref Z contributed by the Durad 120XC (TCP/TXP) while Blend $Z_B$ contained sufficient RDP to equal 125% of the amount of phosphorus contained in Ref. Z contributed by the Durad 120XC (TCP/TXP).

From Table 8 it is seen that the formulations containing the RDP exhibited deposit formation resistance performance superior to that of the reference formulation containing TCP, producing from about 100 to 135 mg less deposits in the VPC test than the TCP-containing formulation.

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated.

What is claimed is:

1. A turbine oil exhibiting maintained or improved antiwear performance as specified in SAE specification AS 5780 comprising a synthetic polyol ester base oil, one or more of a polymeric aryl aminic antioxidant and RDP antiwear additive of the formula:

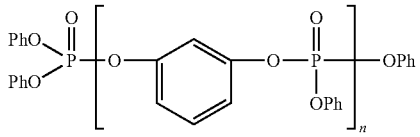

wherein n=1 to 7, Ph is phenyl, the RDP being present in an amount in the range 1 to 2.91 wt % based on active ingredient, wherein the antiwear performance of the turbine oil as measured by the Wedeven Associates Machine (WAM) test ranges from greater than 24 to 30, and wherein the one or more polymeric aryl aminic antioxidant are present in an amount in the range 5.6 to 10 wt % as delivered.

2. The turbine oil of claim 1 wherein the one or more polymeric aryl aminic antioxidants is the polymerized reaction product of one or more diphenyl amines, one or more phenyl naphthyl amines or both one or more diphenyl amines with one or more phenyl naphthyl amines.

3. The turbine oil of claim 2 wherein the one or more polymeric aryl amine antioxidant is the reaction product of:

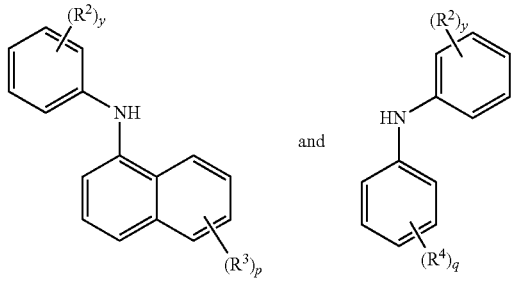

wherein $R^2$ is styrene or a $C_1$ to $C_{30}$ alkyl, $R^3$ is styrene or a $C_1$ to $C_{30}$ alkyl, $R^4$ is styrene or a $C_1$ to $C_{10}$ alkyl, p, q and y individually range from zero to up to the valence of the aryl group to which the respective R groups are attached.

4. The turbine oil of claim 1, 2, or 3, further containing additive amounts of corrosion inhibitors, extreme pressure additives, antifoamants, detergents, hydrolytic stabilizers, metal deactivator, rust inhibitors, colorants, odorants, deodorants, viscosity modifiers, viscosity index improvers, phenolic antioxidants and monomeric aniline antioxidants.

5. A method for maintaining or enhancing the antiwear performance of a High Performance Category turbine oil comprising a synthetic polyol ester base oil, one or more of a polymeric aryl aminic antioxidant and RDP antiwear additive of the formula:

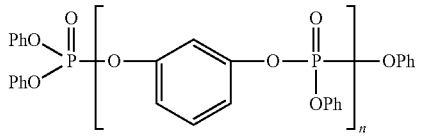

Wherein n=1 to 7, Ph is phenyl, the RDP being present in an amount in the range 1 to 2.91 wt % based on active ingredient, wherein the antiwear performance of the turbine oil as measured by the Wedeven Associates Machine (WAM) test ranges from greater than 24 to 30, and wherein the one or more polymeric aryl a runic antioxidant are present in an amount the range 5.6 to 10 wt % as delivered.

6. The method of claim 5 wherein the one or more polymeric aryl aminic antioxidant is the polymerized reaction product of one or more diphenyl amines, one or more phenyl naphthyl amines or both one or more diphenyl amines with one or more phenyl naphthyl amines.

7. The method of claim 5 wherein the one or more polymeric aryl aminic antioxidants is the reaction product of:

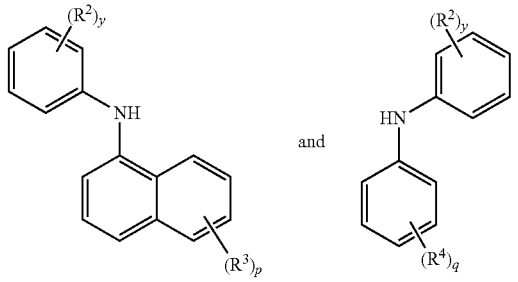

wherein $R^2$ is styrene or a $C_1$ to $C_{30}$ alkyl, $R^3$ is styrene or a $C_1$ to $C_{30}$ alkyl, $R^4$ is styrene or a $C_1$ to $C_{10}$ alkyl, p, q and y individually range from zero to up to the valence of the aryl group to which the respective R groups are attached.

8. The method of claim 5, 6, or 7, wherein the turbine oil further contains additive amounts of corrosion inhibitors, extreme pressure additives, antifoamants, detergents, hydrolytic stabilizers, metal deactivators, rust inhibitors, colorants, odorants, deodorants, viscosity modifiers, viscosity index improvers, phenolic antioxidants and monomeric aminic antioxidants.

* * * * *